United States Patent [19]

Valcho et al.

[11] Patent Number: 4,614,602

[45] Date of Patent: Sep. 30, 1986

[54] LUBRICANT OVERBASED DETERGENT-DISPERSANTS WITH IMPROVED SOLUBILITY

[75] Inventors: Joseph J. Valcho, Naperville; Francis J. Slama, Montgomery; Joseph S. Strukl, Lisle; Chang-Man Park, Naperville, all of Ill.

[73] Assignee: Amoco Corporation, Chicago, Ill.

[21] Appl. No.: 729,468

[22] Filed: May 1, 1985

[51] Int. Cl.[4] ..... C10M 125/00

[52] U.S. Cl. ..... 252/33.3; 252/42.7; 252/40.7

[58] Field of Search ..... 252/33.3, 42.7, 40.7

[56] References Cited

U.S. PATENT DOCUMENTS

| | | | |
|---|---|---|---|
| 4,412,927 | 11/1983 | Demoures et al. | 252/33.3 |
| 4,435,301 | 3/1984 | Brannen et al. | 252/42.7 |
| 4,470,916 | 9/1984 | Le Coent et al. | 252/42.7 |

*Primary Examiner*—William R. Dixon, Jr.
*Assistant Examiner*—Ellen M. McAvoy
*Attorney, Agent, or Firm*—William C. Clark; William T. McClain; William H. Magidson

[57] ABSTRACT

A lubricant composition is disclosed comprising a major amount of a lubricating oil composition and a minor amount of an overbased detergent-dispersant lubricant additive comprising a reaction product of an alkaline earth metal phenate and an ammonium alkylbenzene sulfonate wherein the phenate and the sulfonate are reacted in the presence of an alcohol of 1 to 4 carbon atoms and said reaction product is stripped to remove ammonia, water and said alcohol.

11 Claims, No Drawings

LUBRICANT OVERBASED DETERGENT-DISPERSANTS WITH IMPROVED SOLUBILITY

FIELD OF THIS INVENTION

The field of this invention relates to a composition comprising an overbased detergent-dispersant lubricant additive and to a process for the preparation of said overbased detergent-dispersant additive useful as an additive for lubricating oils. More particularly, this invention relates to a process for the preparation of an overbased detergent-dispersant additive and the composition resulting therefrom comprising a phenate-sulfonate mixture having improved oil solubility and water tolerance in the finished lubricating oil.

It is an object of this invention to provide a process for the preparation of an overbased phenate-sulfonate mixture which demonstrates improved storage at elevated temperatures, improved water tolerance and improved compatibility of the phenate-sulfonate mixture, particularly if water is present.

It is an object of this invention to provide a lubricant composition comprising an overbased detergent-dispersant mixture which has improved compatibility as an additive in a lubricating oil composition and good storage stability at elevated temperatures.

It is an object of this invention to provide a lubricant composition comprising an overbased detergent-dispersant mixture which has improved stability in a lubricating oil composition containing wear inhibitors comprising zinc dithiophosphate.

It is an object of this invention to provide a lubricant composition which has improved water tolerance and comprises an overbased phenate-sulfonate detergent dispersant.

These and other objects will become apparent from the description given hereafter.

BACKGROUND OF THIS INVENTION

Basic sulfurized calcium alkylphenates are used as compounding agents or additives in lubricating oils to neutralize harmful acids in internal combustion engines and to inhibit corrosion, gum formation and piston ring sticking caused by oxidation of the lubricating oil and oxidative polymerization of the engine fuel residues. Metal sulfonates are commonly used in lubricating oil compositions as additives, rust inhibitors and detergents. It is highly desirable for such phenates or sulfonates to provide neutralization capacity for acids formed in engine combustion without too rapid loss in alkalinity. In some cases, these compounding agents or additives are overbased, containing a molar excess of base over that needed to neutralize the phenolic material or sulfonic acid.

A problem associated with the preparation of overbased additive compounds is that of the incompatibility of the mixture of the alkaline earth metal phenate and the sulfonate as a final product. The overbased materials, generally an alkaline earth metal compound, generally a carbonate, are dispersed in the alkaline earth metal dispersing agent, the amount of dispersed alkaline earth metal being known as the overbased amount. Since the greater the basicity of the material the better, as this allows smaller amounts of the material to be used for a given effect in a lubricant, a greater degree of overbasing is highly desirable. However, to increase basicity, it is generally necessary to increase the dispersed alkaline earth metal content of the carbonate complex.

A highly desirable object of overbasing additive agents is to obtain the overbased additive agents in the form of extremely fine particles in a finely dispersed colloidal form such that the lubricant compositions containing the overbased additive agents are stable, are haze-free, are gellation-free and are not subject to appreciable thickening in the absence of promoters.

The instant invented process relates to increased carbonation of an alkaline earth metal phenate and ammonium sulfate to give a resulting product with improved solubility, due to overcoming incompatibility of the phenate and sulfonate.

Overbased phenates, including sulfurized phenates, are commonly manufactured in the presence of ethylene glycol which must be removed from the product. The presence of glycol in overbased phenates can cause engine varnish or lacquer. Phenates are generally the reaction product of phenol or substituted phenol with a metal or ammonium base. Often the metal base is a Group II metal compound. Substituted phenols are generally mono-, di- or tri-hydrocarbyl substituted, such as alkyl, alkenyl, aryl, aralkyl, or alkaryl. Monoalkyl substitution is preferred. The hydrocarbyl can comprise low molecular weight groups such as methyl, ethyl, the isomers of propyl, butyl, pentyl, hexyl, heptyl, octyl, nonyl, decyl and the like up to high molecular weight materials having a number average molecular weight of 10,000 or more. These hydrocarbyl substituents can be intermediate molecular weight polymer olefins such as $C_8$–$C_{100}$ ethylene or propylene or butene polymers. The hydrocarbyl can be substituted with groups such as chlorine, bromine, hydroxy, nitro or sulfonic acid groups so long as such substitution does not interfere with the utility of the composition. The Group II metal compound can comprise a metal oxide, hydroxide, alcoholate, acetate and the like. Common metals are calcium, barium, strontium and magnesium. Often, the metal compound is calcium oxide or hydroxide. Phenates can contain sulfur which can be introduced by reaction of elemental sulfur or $SCl_2$ with phenol or substituted phenol, or by the reaction of elemental sulfur or $SCl_2$ with metal phenate.

Methods of making these various phenates and sulfur-containing phenates and overbasing can be found in U.S. Pat. Nos. 2,680,096; 3,036,971; 3,178,368; 3,336,224; 3,437,595; 3,464,970; 3,761,414; 3,801,507; 3,810,837; 3,923,670; 3,932,289; 3,953,519; 3,966,621 and 3,969,235.

Oil soluble overbased sulfonates are made by reacting a base with oil-soluble sulfonic acids. Suitable oil-soluble sulfonic acids can be aliphatic or aromatic compounds. Suitable aromatic sulfonic acids are the oil-soluble petroleum sulfonic acids, commonly referred to as "mahogany acids," aryl sulfonic acids, and alkylaryl sulfonic acids. Illustrative of such sulfonic acids are dilauryl benzene sulfonic acid, lauryl cetyl benzene sulfonic acid, paraffin-substituted benzene sulfonic acids, polyolefin alkylated benzene sulfonic acids, such as polybutylene alkylated benzene sulfonic acids in which the polybutylene substituents have a molecular weight of at least about 100, and preferably within the range of from about 100 to about 10,000, and polypropylene alkylated benzene sulfonic acids in which the polypropylene substituents have a molecular weight of at least about 80 and preferably within the range of from about 80 to about 10,000. Examples of other suitable sulfonic acids are alpha-olefin benzene sulfonic acids, diparaffin wax-substituted phenol sulfonic acids, acetyl chlorobenzene sulfonic acids, cetyl-phenol disulfide sulfonic acids, cetyl-phenol monosulfide sulfonic acids, and cetoxy capryl benzene sulfonic acids. Other suitable oil-soluble sulfonic acids are well described in the art, such as, for example U.S. Pat. No. 2,616,604; U.S. Pat. No. 2,626,207; and U.S. Pat. No. 2,767,209; and others.

Non-aromatic sulfonic acids are generally made by the sulfonation of most any aliphatic hydrocarbon such as alkanes, alkenes, and the like. Also, the hydrocarbyl may contain various substitutions which do not interfere with later reactions or end use. One preferred group of non-aromatic sulfonic acids is made by the sulfonation of polymers or copolymers, such as polymerized or copolymerized olefins.

The term "polymer olefins" as used herein refers to amorphous polymers and copolymers derived from olefinically unsaturated monomers. Such olefin monomers include olefins of the general formula $RCH{=}CH_2$, in which R comprises hydrogen or an aliphatic or cycloaliphatic radical of from 1 to about 20 carbon atoms, for example, propene, isobutylene, butene-1, 4-methyl-1-pentene, decene-1, vinylidene norbornene, 5-methylene-2-norbornene, etc. Other olefin monomers having a plurality of double bonds may be used, in particular diolefins containing from about 4 to about 25 carbon atoms, e.g., 1,4-butadiene, 2,3-hexadiene, 1,4-pentadiene, 2-methyl-2,5-hexadiene, 1,7-octadiene, etc. These polyolefins have number average molecular weights from about 36 to about 10,000 or higher, but preferably from about 80 to about 10,000. Of these materials, a preferred group is polyethylene or polypropylene or polybutylene polymers. The olefin may be a copolymer, such as an ethylene propylene copolymer or ethylene-propylene-hexadiene terpolymer, or others.

The preparation of the sulfonic acids is well known. Such sulfonic acids can be prepared by reacting the material to be sulfonated with a suitable sulfonating agent, such as concentrated sulfuric acid, fuming sulfuric acid, chlorosulfonic acid or sulfur trioxide for a period of time sufficient to effect sulfonation, and thereafter separating insoluble acid sludge from the oil-soluble sulfonic acid. Overbased sulfonates are commonly made by the reaction of sulfonic acid with metal bases such as the oxide, hydroxide, or carbonate of calcium, magnesium or barium. In some cases, the sulfonate can be made from the metal itself or a derivative of said metal. Suitable processes for making overbased sulfonates are described in U.S. Pat. Nos. 3,126,340; 3,492,230; 3,524,814; and 3,609,076.

U.S. Pat. No. 4,412,927 teaches the preparation of detergent-dispersant compositions useful as additives for lubricating oils having a base of alkylbenzene sulfonates and sulfurized alkylphenates. The process employs sulfurized alkylphenates, alkaline-earth metal alkylbenzene sulfonates, alkylene glycols and carbon dioxide. The process requires carbonating at a temperature between about 100° C. and 250° C., a reaction medium comprising a sulfurized alkylphenate of an alkaline earth metal of a total basic number (TBN) (ASTM Standard D-2896) of between 0 and 170, the said alkylphenate having one or more $C_6$–$C_{60}$ alkyl substituents, an alkaline earth metal alkylbenzene sulfonate of a molecular weight of more than about 300 and a TBN of less than or equal to about 150, an alkaline earth metal compound, an alkylene glycol and a diluent oil. The alkylene glycol is subsequenty removed and the metallic detergent-dispersant is separated.

As is well-known, calcium phenates having TBN's of 80–250 tend to interact with low and high base sulfonates to produce haze and sediment when blended into crankcase oils. This phenate-sulfonate incompatibility can be influenced by the components in a finished oil. For example, the simultaneous presence of zinc dialkyldithiophosphate (ZnDTP) and water can aggravate the phenate-sulfonate interaction. Many finished oils contain ZnDTP. This phenate-sulfonate incompatibility is worsened when the finished oil contains a small amount of water, as can happen during handling and storage.

It has long been known, as evidenced by the preceding recital of the prior art, i.e., U.S. Pat. No. 4,412,927, that an overbased metallic detergent-dispersant can be prepared by carbonating a sulfurized alkylphenate of an alkaline earth metal having a TBN of between 0 and 170, an alkaline-earth metal alkylbenzene sulfonate having a molecular weight of more than 300 and a TBN of less than or equal to 150, an alkaline-earth metal compound, an alkylene glycol and a diluent oil. The resulting product requires removal of the alkylene glycol which can waste raw materials. Incomplete removal of the alkylene glycol can cause engine varnish.

In our process, we have found unexpectedly that if an alkaline earth metal phenate is reacted with an alkylbenzene ammonium sulfonate in the presence of a monoalcohol selected from the group consisting of alcohols of one to four carbon atoms, the resulting product as an overbased composition has improved phenate-sulfonate compatibility. The monoalcohol can be in an alcohol-water solution. These so-called cosynthesized phenate-sulfonates in an overbased state have improved solubility in lubricating oils, particularly in the presence of small amounts of water, are stable colloidal dispersions, are haze-free, are gellation-free, non-viscous and are not subject to appreciable thickening in the absence of promoters. The introduction of carbon dioxide into the cosynthesized phenate-sulfonate mixture can be in any suitable manner such as in the form of an overbased phenate or, preferably, by carbonating under suitable conditions the cosynthesized phenate-sulfonate mixture in the presence of the monoalcohol of one to four carbon atoms.

We have found that optimization of carbonation provides improved water tolerance in lubricating oil additives.

Accordingly, in the prior art it has been taught that a mixture of a sulfurized alkylphenate and an alkaline-metal alkylbenzene sulfonate can be prepared in the presence of an alkylene glycol or a monoalcohol having a boiling point of 120° C. or greater. However, there has been no recognition in the prior art that an improved overbased metallic detergent-dispersant can be prepared in a cosynthesis reaction from a calcium phenate and an alkylbenzene ammonium sulfonate in the presence of a $C_1$ to $C_4$ alcohol, preferably methanol or a methanol-water mixture wherein the calcium phenate and alkylbenzene ammonium sulfonate preferably are overbased together or the phenate is in an overbased state and degree of carbonation is optimized.

SUMMARY OF THE INVENTION

An improved overbased detergent-dispersant additive is disclosed which has excellent water tolerance and excellent room temperature storage stability. Finished lubricant oils containing this additive demonstrate continued brightness and clarity despite a water content of up to 0.20(wt)%. The additive is prepared by reacting an alkaline-earth metal phenate and an alkaline earth metal alkylbenzene sulfonate in a co-synthesis reaction in the presence of a $C_1$ to $C_4$ alcohol, preferably methanol or a methanol-water mixture wherein the reaction mixture is optimally carbonated with carbon dioxide. A high carbonation level aids stability in the presence of water. An alternative procedure is to reflux together an over-based alkaline earth metal phenate and an alkylbenzene ammonium sulfonate in the presence of methanol or a methanol-water mixture wherein the overbased alkaline earth metal phenate has been optimally carbonated. The methanol and excess water are stripped off.

DETAILS OF THE INVENTION

It has now been discovered that an improved overbased detergent-dispersant additive for use in lubricant oils can be prepared by reacting an 80–160 TBN alkaline earth metal phenate with an alkaline earth metal alkylbenzene sulfonate in the presence of a monoalcohol of one to four carbon atoms in a cosynthesis reaction wherein the reaction mixture is optimally carbonated, or, alternatively, an 180 to 260 TBN alkaline earth metal phenate has been previously optimally carbonated before the cosynthesis reaction.

It is preferred that the alkaline earth metal alkylbenzene sulfonate be prepared from alkylbenzene sulfonate which is neutralized with ammonia to form an ammonium alkylbenzene sulfonate. In one procedure, the ammonium alkylbenzene sulfonate and alkaline earth metal phenate are overbased with an alkaline earth metal oxide or hydroxide and carbon dioxide in the presence of a $C_1$ to $C_4$ alcohol, preferably methanol or methanol and water. In another procedure, an overbased alkaline earth metal phenate which has been optimally carbonated and an alkylbenzene ammonium sulfonate are refluxed together in the presence of methanol or a methanol-water mixture. The methanol, water and ammonia are thereupon stripped from the final product.

The alkaline earth metal oxide or hydroxide can be selected from calcium oxide, calcium hydroxide, magnesium oxide, magnesium hydroxide, barium oxide, barium hydroxide and the like.

The overbased detergent-dispersant lubricant additive can be overbased by carbonating said phenate and sulfonate as a reaction mixture at a temperature of from about 25° C. (77° F.) to about 90° C. (194° F.) at a rate of from about 0.25 liters/minute of carbon dioxide to about 1.0 liters/minute per 1000 g of product for at least $1\frac{1}{2}$ hours.

In the prior art, it is known that when an alkaline earth metal sulfonate is overbased by reaction in the presence of an alkylene glycol with an alkaline earth metal oxide or hydroxide without prior neutralization with ammonia to form the ammonium salt, the overbasing reaction proceeds slowly as compared to the same over-basing reaction of the ammonium salt. It has been found that a detergent-dispersant mixture of the overbased alkaline earth metal sulfonate and an alkaline earth metal phenate typically does not have the water tolerance and storage stability of the instant invented composition.

In our process, the cosynthesis reaction mixture in a $C_1$ to $C_4$ monoalcohol and the use of an ammonium neutralized alkylbenzene sulfonate which is subsequently reacted with an alkaline earth metal oxide or hydroxide and carbon dioxide to prepare the required alkaline earth metal alkylbenzene sulfonate clearly distinguishes the final complex product from any overbased detergent-dispersant type material hereto disclosed. Moreover, the nature of the overbased product formed by use of the alkaline earth metal alkylbenzene sulfonate and the calcium phenate in the presence of methanol is quite different from the other prior art alkaline-earth metal detergent-dispersant compositions previously known or produced. The product is clearer.

In more detail, the alkaline earth metal alkylbenzene sulfonate and alkaline earth metal phenate can be prepared with different alkyl substituents. The alkaline earth metals can be broadly defined. The phenate:sulfonate mole ratio can be from 0.2:1.0 to about 4.0:1, preferably 1.2:1.

Among the sulfurized alkylphenates which can be employed are those obtained by sulfurization with sulfur of an alkylphenol bearing $C_{8-C60}$ alkyl substituents, or more, preferably one or more $C_9$–$C_{15}$ alkyl substituents, such as the nonyl, decyl, dodecyl, or tetradecyl phenols.

Among the alkylbenzene sulfonates which can be used are the natural sulfonic acid salts of a molecular weight preferably of more than 400 obtained by sulfonation of petroleum cuts or synthetic salts obtained by sulfonation of alkylbenzenes derived from olefins or polymers of $C_2$–$C_4$ olefins of chain length $C_{15}$–$C_{80}$ and alkaline-earth metals, such as calcium, barium, magnesium, etc.

The alkaline-earth metal compound to be used may consist of oxides or hydroxides of calcium, barium, magnesium, etc., alone or in mixture. The metal from which the alkaline-earth metal alkylbenzene sulfonate and the alkaline earth alkylphenate used are derived may or may not be the same as that of those contained in the alkaline earth metal compound.

To further illustrate the large number and variety of classes of alkaline earth metal compounds which can be employed, specific examples thereof are enumerated below.

The alkaline earth metal compounds include the barium-containing compounds such as barium hydroxide, barium oxide, barium sulfide, barium carbonate, barium bicarbonate, barium hydride, barium amide, barium chloride, barium bromide, barium nitrate, barium sulfate, barium borate, etc.; the calcium-containing compounds such as calcium hydroxide, calcium oxide, calcium sulfide, calcium carbonate, calcium bicarbonate, calcium hydride, calcium amide, calcium chloride, calcium bromide, calcium nitrate, calcium borate, etc.; the strontium-containing compounds such as strontium hydroxide, strontium oxide, strontium sulfide, strontium carbonate, strontium bicarbonate, strontium amide, strontium nitrate, strontium hydride, strontium nitrite, etc.; the magnesium-containing compounds such as magnesium hydroxide, magnesium oxide, magnesium carbonate, magnesium bicarbonate, magnesium nitrate, magnesium nitrite, magnesium amide, magnesium chloride, magnesium sulfate, magnesium hydrosulfide, etc. The corresponding basic salts of the above-described compounds are also intended; however, it should be understood that the alkaline earth metal compounds are not equivalent for the purposes of the present invention, because under certain conditions some are more effective or desirable than others.

Alcohols of from 1 to 4 carbon atoms such as methanol, ethanol, propanol, butanol and their isomers can be employed. Methanol is preferred.

In more detail, the sulfonic acid can be a 400 to 1200 molecular weight sulfonic acid derived from polymers of $C_2$ to $C_4$ olefins by sulfonation of the polymer or by sulfonation of the benzene or toluene alkylation product. Preferred is an 800 molecular weight polypropylene or polybutylene alkylated benzene sulfonic acid neutralized with ammonia or magnesium oxide or magnesium hydroxide. More preferred is an 800 molecular weight polypropylene alkylated benzene sulfonic acid neutralized with ammonia. The ammonium base is preferred because of improved carbon dioxide adsorption efficiency.

The calcium phenate is a low-based phenate prepared by reacting an alkylated phenol with sulfur and calcium hydroxide or calcium oxide in the presence of a monoalcohol, an alkyl glycerol, a glycerol monoester, or an alkyl 1,2-diol. Examples are ethylene glycol, monoalcohols of at least eight carbon atoms including, n-or i-octanol, 2-ethyl hexanol, and decanol. Examples of alkyl glycerol are glycerol monooleate, and glycerol monostearate. Examples of 1,2-diols are ethylene glycol, 1,2-dihydroxy octane and 1,2-diols derived from commercial $\alpha$-olefins. Ethylene glycol is preferred because of availability, ease of removal, and economic aspects. Examples of the alkylated phenol are dodecyl phenol and $C_9$–$C_{30}$ olefin polymers of $C_2$–$C_4$ olefin alkylated phenol.

The alkaline earth metal alkylbenzene sulfonate and alkaline earth metal phenate cosynthesized mixture is blended with other additives to form a so-called additive package at a temperature within the range of from about 160° F. to about 275° F. or higher under nitrogen for 1 to 24 hours, at pressures of from 0.5 to 100 atmospheres. Additive blends containing thermally unstable additives such as zinc dithiophosphate can be blended at 160° F. for about three hours.

Of particular significance, in accordance with the present invention, is the ability to improve the storage properties of compositions of over-based detergent-dispersants and oleaginous materials such as lubricating media which may comprise either a mineral oil or a synthetic oil. In general, mineral oils, both paraffinic, naphthenic and mixtures thereof, employed in the lubricant viscosity range, as for example, from about 45 SSU at 100° F. to about 6000 SSU at 100° F., and preferably, from about 40 to about 250 SSU at 210° F. These oils may have viscosity indexes ranging to about 100 or higher. Viscosity indexes from about 70 to about 95 are preferred. The average molecular weights of these oils may range from about 250 to about 800.

In instances where synthetic oils are desired in preferance to mineral oils, or in combination therewith, various compounds of this type may be successfully utilized. Typical synthetic vehicles include polyisobutylene, polybutenes, hydrogenated polyolefins, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogeneated mineral oils, chain-type polyphenyls, siloxanes and silicones (polysiloxanes), alkylsubstituted diphenyl ethers typified by a butyl-substituted bis(p-phenoxy phenol) ether, phenoxy phenylethers.

The term lubricating oil composition as used herein is meant to refer to fully formulated compositions intended for use, such as crankcase motor oils, which contain a major portion of a base oil as a lubricating oil and a number of conventionally used additives in typical amounts to provide their normal attendant functions, especially detergents and dispersants of the ash-producing or ashless type, oxidation inhibitors, rust inhibitors, viscosity index improvers, e.g., olefin copolymers, pour point depressants, and metal-containing detergent additives, such as neutral and basic metal phenates, sulfurized phenates and sulfonates with calcium and magnesium, such as a high-base magnesium sulfonate, and zinc dialkyldithiophosphates as anti-oxidant and wear inhibitor additives.

It is understood, therefore, that the lubricant oil compositions contemplated herein can contain other materials. For example, corrosion inhibitors, rust inhibitors such as magnesium sulfonate, nitrogen-containing dispersants, extreme pressure agents, viscosity index improvers, co-antioxidants, anti-wear agents such as zinc dialkyldithiophosphate and the like can be used. These materials do not detract from the value of the compositions of this invention, but rather they serve to impart their customary properties to the particular compositions in which they are incorporated.

In general, the over-based detergent-dispersants of the present invention can be employed in any amount which is effective for imparting the desired degree of improved storage at room temperature or at elevated temperatures. In many applications, however, the over-based detergent-dispersant is effectively employed in amounts from about 0.5% to about 15% by weight, and preferably from about 0.5 to about 5% of the total weight of the composition.

The following examples are illustrative of typical compositions of the instant invention and of methods of preparing them. Percentages shown are weight percentages unless otherwise stated.

EXAMPLE I

This example illustrates preparation of an overbased detergent-dispersant in a cosynthesis reaction without previous filtration of the phenate. A low-base ~ 125 TBN calcium dodecyl phenate, 420 gms., was added to 242 g of polypropylene alkylbenzene ammonium sulfonate, 158 g of 5W oil, and 30 g of calcium oxide were added. At 115° F., a solution of 6 g of water in 103 ml of methanol was added slowly. The mixture was refluxed for 30 minutes, and then carbonated at 120° F. for 80 min. with 0.5 l/min. of carbon dioxide. After stripping to 350° F., the product was filtered (104 TBN, 2.19% sulfur).

EXAMPLE II

An overbased detergent-dispersant additive was prepared by mixing an alkaline-earth metal phenate and an alkylbenzene ammonium sulfonate in a cosynthesis over-basing reaction. A mixture comprising 848 g of an ammonium-neutralized polypropylene alkylated benzene sulfonate of 800–900 equivalent weight, 1575 g of a 120 TBN low base calcium sulfurized dodecyl phenate, 552 g of a 5W oil, and 100 g calcium oxide were stirred in a four-liter resin kettle at 100° F. To this was added a blend of 360.5 ml methanol and 17.5 g water, and the mixture was refluxed for 30 minutes. After cooling to 120° F., the mixture was blown with carbon dioxide at 1.0 l/min. for 2 hours. The solution was stripped to 200° F. with nitrogen, 40 ml of water was added to help displace methanol, and the temperature was raised to 350° F. The product (3078 g) was then filtered to give 93–118 TBN cosynthesized phenate sulfonate (average TBN=102), containing 2.24% sulfur and 4.3% calcium.

EXAMPLE III

The procedure of Example II was repeated. Into a 12-liter round bottom flask were charged 1845 g of alkylbenzene ammonium sulfonate (55.1% sulfonate, 43.7% oil, and 900 equivalent weight), 2835 g of 125 TBN calcium dodecyl phenate, and 675 g of 5W oil which was treated with ammonia for 15 min. while stirring. Calcium hydroxide (270 g) and 900 ml methanol were added and the mixture was refluxed for 30 min. After cooling to 120° F., the mixture was carbonated at 1.2 l/min. for 135 min. After stripping to 350° F. with 0.71 l/min. nitrogen, and filtering, the product had a TBN of 94.

EXAMPLE IV

This example illustrates that high base magnesium sulfonate can be incorporated into the cosynthesis reaction as described in Example II.

In the procedure of Example II, a mixture of 567 g of ammonium-neutralized polypropylene alkylene benzene sulfonate, 1051 g of calcium dodecyl phenate, 459 g of 5W oil, 63.4 g of calcium oxide, and 263 g of 400 TBN magnesium sulfonate was warmed to 100° F. in a 4-liter resin kettle. To this was added a solution of 14 g of water in 240 ml of methanol, followed by a two-hour reflux. The mixture was carbonated at 0.8 l/min. for 120 min. Following stripping to 195° F., 20 ml of water was added. After nitrogen stripping to 350° F., the filtered product had a TBN of 125.

EXAMPLE V

The following example illustrates the improved characteristics of a blended formulation containing a calcium dodecyl phenate. The blend contained a low-base sulfonate, a calcium dodecyl phenate and zinc dithiophosphate.

A mixture of 100 g calcium dodecyl phenate, TBN 105, 373 g of polypropylene alkylbenzene ammonium sulfonate, 659 molecular weight, and 205 g of SX-5 oil was prepared. The mixture was sparged with ammonia at 0.71 l/min until the temperature ceased rising to neutralize the mixture. Then 30 g CaO (0.53 mole), 9.6 ml $H_2O$ (1 mole/mole CaO), and 43 ml $CH_3OH$ (2 moles/mole CaO) were added. The mixture was carbonated at 120°–130° F. for 25 min. at 0.636 l/min., 5.98 l being absorbed. The product mix was stripped, cooled, water was added, and then stripped and filtered. The product had a TBN of 49. A formulation of the cosynthesized phenate-sulfonate in an additive containing 5(wt)% zinc dithiophosphate (ZnDTP) at 25° C. for 24 hours gave the following results:

| | % Sediment | % Rag |
|---|---|---|
| Test mixture with ZnDTP | trace | 0 |
| Test mixture without ZnDTP | trace | 0 |
| Control with ZnDTP | 3 | 4 |

The control was a mixture of calcium sulfonate and calcium phenate that was not cosynthesized. "Rag" is very light, fluffy material that would become sediment if centrifuged for a prolonged period.

EXAMPLE VI

The following example illustrates that even with a lower-based product than in Example V, improved results are obtained with a blended formulation.

A phenate was made in the procedure of Example V using 0.50 mole $Ca(OH)_2$, 1.1 moles sulfur, and 0.4 mole ethylene glycol per mole of dodecyl phenol, and 0.75 g SX-5 oil per g of dodecyl phenol. The product had a TBN of 105 after stripping of the glycol.

The phenate-sulfonate cosynthesis was: 100 g phenate (52% phenols, 105 TBN), 373 g alkyl sulfonate (60% soap, 659 MW sulfonic acid), and 205 g SX-5 oil.

The mixture was sparged with ammonia in the procedure of Example V to neutralize the mixture. Then 22 g CaO (0.39 mole), 7.0 ml $H_2O$ (1 mole/mole CaO) and 32 ml $CH_3OH$ (2 moles/mole CaO) were added. The mixture was carbonated 11 min. at 0.61 l/min., 4.0 l being absorbed at 120°–130° F., stripped, cooled, water added, stripped again and filtered. The product had a TBN of 30.

The control is a lubricant mixture comprising 4% 5W oil, 5% zinc dithiophosphate (ZnDTP), 15% phenate, 76% low base sulfonate; 180° F. blend; overnight storage at 150°–200° F.; 50/50 hexane blend centrifuged at 1750 rpm for 20 min. The test mixture is a mixture comprising 4% SW oil, 5% ZnDTP, and 91% of the 30 TBN cosynthesized phenate-sulfonate.

| | % Sediment | % Rag |
|---|---|---|
| Test mixture | trace | 0 |
| Control | 10 | 11 |

EXAMPLE VII

The products of Example I, II, III and IV were blended at 4.25 (wt)% into a heavy-duty lubricating oil composition and then mixed with water as follows: 0.10%, 0.15% and 0.20%. The heavy-duty lubricating oil composition contained a nitrogen-containing dispersant, a zinc dialkyldithiophosphate wear inhibitor, a high-base magnesium sulfonate, a pour-point depressant and base oil. The samples were stored at room temperature (72° F.) and 130° F. for up to 51 days. If haze, floc or sediment developed, the test was terminated at an earlier period.

TABLE I

| | | | | Haze, Floc and Sediment Upon Storage | | |
|---|---|---|---|---|---|---|
| % $H_2O$ Example | TBN (1) | TBN(2) as Carbonate | Days | 0.10 | 0.15 | 0.20 |
| | | | | | 72° F. | |
| I | 104 | 79 | 31 | ✓ | ✓ | ✓ |
| II | 102 | 64 | 51 | C(a) | N(a) 5%(b) | N(a) 4%(b) |
| III | 94 | 69 | 51 | ✓ | ✓ | F(a) |
| IV | 125 | — | 26 | ✓ | ✓ | ✓ |
| Control (c) | 96 | 31 | 30 | ✓ | H(a) 2%(b) | N(a) 5%(b) |
| | | | | | 130° F. | |
| I | 104 | 79 | 31 | ✓ | ✓ | H(a) |
| II | 102 | 64 | 51 | ✓ | ✓ | ✓ |
| III | 94 | 69 | 51 | ✓ | ✓ | ✓ |
| IV | 125 | — | 26 | ✓ | ✓ | ✓ |
| Control | 96 | 31 | 30 | ✓ | B(a) 4%(b) | >N(a) 6%(b) |

TABLE I-continued

| % $H_2O$ Example | TBN (1) | TBN(2) as Carbonate | Haze, Floc and Sediment Upon Storage Days | 0.10 | 0.15 | 0.20 |
|---|---|---|---|---|---|---|
| (c) | | | | | | |

(1)Per ASTM D-2896 titration with perchloric acid
(2)Per coulometric titration
Note:
(a)Haze rating: A-clear, B to N-increased haze
(b)% is volume % haze, floc and sediment
(c)Control additive: blended at 4.25(wt) % to same level of sulfonate and phenate soaps and total calcium as provided by cosynthesis Examples of I, II, III, and IV.
(d)✓indicates clear and no sediment in mixture resulting from components used.

The following examples illustrate the preparation of cosynthesized mixtures of different phenate-sulfonate ratios.

EXAMPLE VIII

A calcium phenate was prepared in the following procedure. A mixture of 1310 g of dodecyl phenol 1240 g of 5W oil, 105 g of ethylene glycol, 175 g of sulfur, 185 g of $Ca(OH)_2$ was stirred for 30 min. at 360° F. Carbonation of 0.8 l/min. was begun, followed by the addition of 65 g of sulfur, 103 g $Ca(OH_2)$ and 250 g of ethylene glycol. After 30 min., an additional 195 g of calcium hydroxide and 100 g of ethylene glycol were added and stirring was continued for 90 min. The mixture was stripped for 1 hour at 440°–460° F. with nitrogen at 1.0 l/min. The products had TBNs of 195–210.

EXAMPLE IX

A mixture of filtered 4228 g of phenate, (nitrogen stripped) from Example VIII, 2537 g of polypropylene alkylbenzene ammonium sulfonate and 921 g of 5W oil was warmed to 100° F. To this was added 47 g of water in 940 ml of methanol, followed by a one-hour reflux. The mixture was stripped to 350° F. with nitrogen and filtered through Celite (100 TBN, 2.78% sulfur, 7524 g before filtration).

EXAMPLE X

The following illustrates a preparation using a $N_2$ stripped calcium dodecyl phenate and a 1 hour reflux. A mixture of 1800 g of filtered nitrogen stripped phenate from Example VIII, 1080 g of polypropylene alkylbenzene ammonium sulfonate and 392 g of 5W oil was refluxed with 400 ml of methanol and 20 g of water for one hour, and worked-up as described in Example IX (92 TBN).

EXAMPLE XI

The following illustrates a preparation using an unfiltered $N_2$ stripped calcium dodecyl phenate and a 1 hour reflux. A mixture of 700 g of unfiltered, nitrogen stripped, phenate from Example VIII and B 420 g of polypropylene alkylbenzene ammonium sulfonate were reacted together and worked-up with a 1 hour reflux as described in Example IX. The product had a TBN of 98.

The following examples illustrate preparation using a nitrogen stripped calcium dodecyl phenate with 1 hour reflux and a low methanol/water ratio.

EXAMPLE XII

A mixture of 200 g of filtered phenate (nitrogen stripped) from Example IX, 120 g of polypropylene alkylbenzene ammonium sulfonate, and 43 g of 5W oil was warmed to 100° F. A solution of 4 g of water in 18 ml of methanol was added. Following one-hour reflux and work-up as in Example IX, the product had a TBN of 95.

EXAMPLE XIII

In the procedure of Example IX, a mixture of 400 g of unfiltered phenate (nitrogen stripped) from Example VIII, 240 g of polypropylene alkylbenzene ammonium sulfonate and 87 g of 5W oil was heated to 100° F. with 8 g of water in 35 ml of methanol. Following 1 hour reflux and work-up as described in Example IX, the product had a TBN of 92.

EXAMPLE XIV

A mixture of 320 g of an overbased filtered calcium dodecyl phenate (nitrogen stripped) prepared in the procedure of Example VIII but with extra calcium hydroxide (260 TBN continuous process), 280 g of polypropylene alkylbenzene ammonium sulfonate (66% sulfonate), 35 ml of methanol, and 8 ml of water was refluxed for one hour. The product was stripped to 350° F. and filtered through Celite (101 TBN).

EXAMPLE XV

The following illustrates product obtained wherein the phenate is stripped with nitrogen, and refluxed for 3 hours. A mixture of 700 g of phenate from Example IX nitrogen stripped, 420 g of polypropylene alkylbenzene ammonium sulfonate (55.1% sulfonate) and 152 g of 5w oil were warmed to 100° F. To this was added 9 g water in 175 ml methanol and the mixture was refluxed for three hours. The product was stripped at 350° F. with nitrogen and then filtered through Celite. The product had a TBN of 98.

EXAMPLE XVI

The products of Examples X through XV were blended into a heavy-duty oil in the procedure of Example VII and then mixed with water as follows: 0.05%, 0.10%, 0.15% and 0.20%. The samples were stored at room temperature (72° F.) and 130° F. for up to 37 days. None of the examples showed haze, floc, or sediment at 0.05% or 0.10% water. The control, prepared without cosynthesis, showed haze at 0.15% water and 0.20% water at room temperature as did the sample from Example XIV. At 130° F. the control showed slight haze at 0.15% and 0.20% water. Examples XI, XII, and XIII showed haze at 0.20% water and 130° F. Example XV at 130° F. showed floc at 0.10% water and haze at 0.15% and 0.20% water. Results are in Table II.

TABLE II

| % $H_2O$ Example | Days | Haze, Floc and Sediment Upon Storage 72° F. 0.15 | 72° F. 0.20 | 130° F. 0.10 | 130° F. 0.15 | 130° F. 0.20 |
|---|---|---|---|---|---|---|
| Control | 23 | H-2% | M-5% | ✓ | B-4% | >-7% |
| IX | 37 | F | I-2% | ✓ | C | ✓ |
| X | 37 | ✓ | ✓ | ✓ | ✓ | ✓ |
| XI | 37 | ✓ | ✓ | ✓ | ✓ | D |
| XII | 37 | ✓ | ✓ | ✓ | ✓ | C |
| XIII | 37 | ✓ | ✓ | ✓ | ✓ | C |
| XIV | 37 | ✓ | ✓ | ✓ | ✓ | ✓ |
| XV | 37 | F-Floc | N-3% Floc | G-t Floc | E-2% | J-7% |

Note:
t = trace; ✓ indicates clear and no sediment in mixture resulting from components used. Haze, floc and sediment are in volume percent.

As shown in Table II, an overbased detergent-dispersant prepared in the cosynthesis procedure of Example X demonstrated water tolerance at 0.20% water at room temperature and at 130° F. Overbased detergent-dispersants prepared in the procedures of Examples XI, XII and XIII demonstrated slight haze at 130° F. and 0.20% added water.

Example IX had poor 0.20% water tolerance at 72° F. Example XV had poor water tolerance at 72° F. and 130° F.

The following examples illustrate that regulating the carbonation of the mixture of phenate and sulfonate improves the water tolerance and solubility of the cosynthesized reaction mixture.

Thirteen examples were prepared with different TBN's, using polypropylene benzene ammonium sulfonate and calcium phenate. Each example was carbonated with carbon dioxide as described in Example II for periods to obtain the required minimum TBN of 96–106. Some products had TBN's of up to 118. The products were blended into a heavy-duty oil as in Example VII and then mixed with water at 0.05%, 0.10%, 0.15% and 0.20% water. No haze, floc, or sediment developed in any example products at 0.5% or 0.10% water at 72° F. At 130° F., haze developed in the products of two examples at 0.10% water. Results are in Table III.

TABLE III

| | Haze, Floc and Sediment Upon Storage and Carbonation | | | | | | |
|---|---|---|---|---|---|---|---|
| % $H_2O$ | TBN | TBN[2] as Car- | 72° F. | | 130° F. | | |
| Example | [1] | bonate | 0.15 | 0.20 | 0.10 | 0.15 | 0.20 |
| XVII | 106 | 64 | I | >N-4% | ✓ | Floc-4% | N-3% |
| XVIII | 106 | 60 | F | >N-5% | ✓ | E-2% | K-4% |
| XIX | 111 | 69 | I | >N-4% | ✓ | K-2% | N-3% |
| XX | 104 | 69 | M-2% | >N-4% | ✓ | I-2% | K-4% |
| XXI | 84 | 37 | N-5% | >N-8% | I-2% | N-2% | M-5% |
| XXII | 118 | 89 | ✓ | ✓ | ✓ | ✓ | ✓ |
| XXIII | 115 | 89 | ✓ | ✓ | ✓ | ✓ | ✓ |
| XXIV | 110 | 90 | ✓ | ✓ | ✓ | ✓ | ✓ |
| XXV | 104 | 90 | ✓ | ✓ | ✓ | ✓ | ✓ |
| XXVI | 111 | 84 | ✓ | ✓ | ✓ | ✓ | ✓ |
| XXVII | 104 | 84 | ✓ | ✓ | ✓ | ✓ | ✓ |
| XXVIII | 103 | 79 | ✓ | ✓ | ✓ | ✓ | ✓ |
| XXIX (Control) | 96 | 31 | H-2% | N-5% | ✓ | B-4% | >N-6% |

[1]Per ASTM D-2896 titration with perchloric acid.
[2]Per coulometric titration.
Note:
✓indicates clear and no sediment in mixture resulting from components used. Haze, floc and sediment are in volume percent.

As the above table indicates, increased level of carbonation improves solubility and water tolerance.

EXAMPLE XXX

A mixture of 184.5 g of polypropyl benzene ammonium sulfonate and 283.5 g of 125 TBN calcium dodecyl phenate and 75 g of SX-5 oil were dissolved in 300 ml of mixed xylenes. At 100° F., 75 g of CaO, and 100 ml of methanol containing 5 g of water, were added. The mixture was carbonated at 0.5 l/mi. for two hours (45 g $CO_2$ uptake) and stripped to 250° F. to remove methanol and water. The product was filtered and stripped to 350° F. to remove xylenes, had a TBN of 247, and had only a trace of solids when dissolved in hexane. When 30 ml of this product was dissolved in 60 ml of naphtha and 10 ml of high-base magnesium sulfonate was added, no sediment or haze formed. When 16.7% of 300 TBN calcium sulfonate and 20 ml of 250 TBN calcium dodecyl phenate were dissolved in 63.3 ml of naphtha, 0.25% sediment formed. When 16.7 ml 300 TBN sulfonate, 9.2 ml of 250 TBN calcium dodecyl phenate and 10 ml of high-base magnesium sulfonate were added, 0.30% of solids formed. This shows that a higher TBN version of a cosynthesized phenate/sulfonate composition also shows good solubility and compatibility. The higher TBN product can be useful for marine diesel lubricating oil compositions and other heavy duty applications with better stability than an oil composition obtained by only blending phenates and sulfonates together.

What is claimed is:

1. A lubricating composition comprising a major amount of a lubricating oil composition and a minor amount of an overbased detergent-dispersant lubricant additive, in an amount of from about 0.5% to about 15% by weight of the total weight of said lubricating oil composition, said additive comprising a reaction product of an alkaline earth metal phenate, and an ammonium alkylbenzene sulfonate, wherein said phenate and said sulfonate are reacted in the presence of an alcohol to 1 to 4 carbon atoms, at a temperature of from about 25° C. to about 90° C. and pressure of from about 0.5 to about 7 atmospheres, and said reaction product is stripped at a temperature of from about 100° C. to about 200° C. and pressure of from about 0.1 to about 1 atmosphere, to remove ammonia, water and said alcohol.

2. The overbased detergent-dispersant lubricant additive of claim 1 wherein said additive comprises a reaction mixture of an alkaline earth metal phenate and an ammonium alkylbenzene sulfonate reacted in the presence of an alcohol of 1 to 4 carbon atoms, and stripped to remove ammonia, water, and said alcohol, wherein mole ratio of said phenate to said sulfonate is in the range of from 0.2:1.0 to about 4:1.

3. The lubricant additive of claim 2 wherein mole ratio of said phenate to said sulfonate is about 1.2:1.

4. The lubricant additive of claim 1 wherein said alkaline earth metal phenate has a TBN of from about 180 to about 260 and is refluxed with ammonium sulfonate in the presence of methanol and water.

5. The lubricant additive of claim 1 wherein a high base magnesium sulfonate is added to said sulfonate and said phenate prior to addition of alcohol and water.

6. The lubricant additive of claim 1 wherein said overbased detergent-dispersant lubricant additive is overbased by carbonating said phenate and sulfonate as a reaction mixture with carbon dioxide at a temperature of from about 25° C. to about 90° C. at a rate of from about 0.25 liters/minute of $CO_2$ to about 1.0 liters/minute per kilogram of reaction mixture.

7. The lubricant additive of claim 6 wherein said carbonating results in a TBN of from about 65 to about 120 as carbonate of total TBN of from about 80 to about 150 total TBN, as measured by ASTM D-2896.

8. The lubricant additive of claim 6 wherein said carbonating results in a TBN of from about 70 to about 95 as carbonate of total TBN of from about 90 to about 120 total TBN, as measured by ASTM D-2896.

9. The lubricant additive of claim 1 wherein said overbased detergent-dispersant lubricant additive is overbased by optimally carbonating said phenate with carbon dioxide at a temperature of from about 25° C. to about 90° C. at a rate of from about 0.10 liters/minute to about 1.0 liter/minute of carbon dioxide per kilogram of said reaction mixture for at least one hour.

10. The lubricating composition of claim 1 wherein said overbased detergent-dispersant lubricant additive is present in an amount of from about 0.5 (wt)% to about 5 (wt)% of the total weight of the lubricating composition.

11. The lubricating composition of claim 1 comprising a major amount of a lubricating oil composition and a minor amount of an overbased detergent-dispersant lubricant additive wherein the said lubricating oil composition comprises a nitrogen-containing dispersant, a zinc dialkyldithiophosphate wear inhibitor, a high-base magnesium sulfonate, a pour point depressant and base oil.

* * * * *